US010044108B2

(12) United States Patent
Jablon et al.

(10) Patent No.: US 10,044,108 B2
(45) Date of Patent: Aug. 7, 2018

(54) HELICAL ANTENNA APPARATUS AND METHODS

(71) Applicant: The Johns Hopkins University, Baltimore, MD (US)

(72) Inventors: Allan R. Jablon, Ellicott City, MD (US); Gerald F. Ricciardi, Mount Airy, MD (US)

(73) Assignee: The Johns Hopkins University, Baltimore, MD (US)

( * ) Notice: Subject to any disclaimer, the term of this patent is extended or adjusted under 35 U.S.C. 154(b) by 163 days.

(21) Appl. No.: 15/347,902

(22) Filed: Nov. 10, 2016

(65) Prior Publication Data

US 2017/0207540 A1 Jul. 20, 2017

Related U.S. Application Data

(60) Provisional application No. 62/278,475, filed on Jan. 14, 2016.

(51) Int. Cl.

| | |
|---|---|
| ***H01Q 1/36*** | (2006.01) |
| ***H01Q 11/08*** | (2006.01) |
| ***H01Q 19/02*** | (2006.01) |

(52) U.S. Cl.

CPC ..... *H01Q 11/083* (2013.01); *H01Q 1/362* (2013.01); *H01Q 19/025* (2013.01)

(58) Field of Classification Search

CPC ..... H01Q 11/083; H01Q 1/362; H01Q 19/025
USPC ..... 343/895
See application file for complete search history.

(56) References Cited

U.S. PATENT DOCUMENTS

| | | | |
|---|---|---|---|
| 4,608,574 | A | 8/1986 | Webster et al. |
| 5,896,113 | A | 4/1999 | O'Neill, Jr. |
| 5,909,196 | A | 6/1999 | O'Neill, Jr. |
| 6,653,987 | B1 | 11/2003 | Lamensdorf et al. |
| 8,547,291 | B1 | 10/2013 | Josypenko |

*Primary Examiner* — Andrea Lindgren Baltzell
(74) *Attorney, Agent, or Firm* — Noah J. Hayward

(57) ABSTRACT

Example apparatuses and methods relating to antennas are provided. An example apparatus in the form of an antenna assembly includes a first conductor structurally formed into a plurality of first conductor structural waves and a second conductor structurally formed into a plurality of second conductor structural waves. The first conductor and second conductor may be helically wound to form a bifilar helix structure having a proximal end and a distal end. The first conductor and the second conductor may be operatively coupled at the proximal end of the bifilar helix structure to form a signal feed point, and the first conductor and the second conductor are operatively coupled at the distal end of the bifilar helix structure to form a load point.

20 Claims, 7 Drawing Sheets

HELICAL ANTENNA APPARATUS AND METHODS

CROSS-REFERENCE TO RELATED APPLICATIONS

This application claims priority to and the benefit of prior-filed, U.S. Provisional Application Ser. No. 62/278,475 filed on Jan. 14, 2016, the entire contents of which are hereby incorporated herein by reference.

STATEMENT OF GOVERNMENTAL INTEREST

This invention was made with Government support under contract number N00024-03-D-6606 awarded by Naval Sea Systems Command (NAVSEA). The Government has certain rights in the invention.

TECHNICAL FIELD

Exemplary embodiments described herein generally relate to antenna technology, and more specifically relate to antenna technologies associated with a bifilar helix structure.

BACKGROUND

Wireless communications have become a common-place necessity for interacting in business and personal settings. The revolution associated with the internet of things (IOT) continues to push the evolution of wireless technologies to connect virtually all electronic devices. While wireless solutions have been developed to meet user's needs, there is a continual desire for physically smaller and more flexible wireless devices. One component of a wireless communications device that adds to the device's size is the antenna. As such, technologies that reduce the size of the antenna, while still supporting operation of the antenna at selected frequencies, or even broader ranges of frequencies, continue to be desired.

BRIEF SUMMARY OF SOME EXAMPLES

Example apparatuses and methods relating to antenna technology are provided. According to one example embodiment, an example antenna assembly is provided. The example antenna assembly may comprise a first conductor structurally formed into a plurality of first conductor structural waves and a second conductor structurally formed into a plurality of second conductor structural waves. The first conductor and second conductor may be helically wound to form a bifilar helix structure having a proximal end and a distal end. The first conductor and the second conductor may be operatively coupled at the proximal end of the bifilar helix structure to form a signal feed point, and the first conductor and the second conductor may be operatively coupled at the distal end of the bifilar helix structure to form a load point.

According to another example embodiment, an example communications device is provided. The example communications device may comprise a transceiver and an antenna. The antenna may be operably coupled to the transceiver. The antenna may comprise a first conductor structurally formed into a plurality of first conductor structural waves and a second conductor structurally formed into a plurality of second conductor structural waves. The first conductor and second conductor may be helically wound to form a bifilar helix structure having a proximal end and a distal end. The first conductor and the second conductor may be operatively coupled at the proximal end of the bifilar helix structure to form a signal feed point, and the first conductor and the second conductor may be operatively coupled at the distal end of the bifilar helix structure to form a load point.

According to another example embodiment, an example method is provided. The example method may comprise structurally forming a plurality of first conductor structural waves in a first conductor, and structurally forming a plurality of second conductor structural waves in a second conductor. The example method may further comprise helically winding the first conductor and the second conductor to form a bifilar helix structure. The bifilar helix structure may have a proximal end and a distal end. The first conductor and the second conductor may be operatively coupled at the proximal end of the bifilar helix structure to form a signal feed point, and the first conductor and the second conductor may be operatively coupled at the distal end of the bifilar helix structure to form a load point.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

Figure 4A:
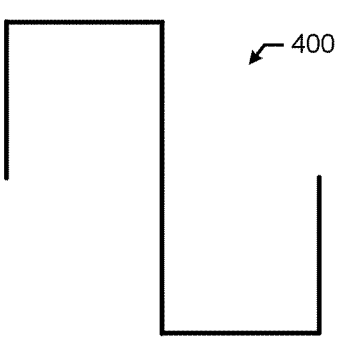
Figure 4B:
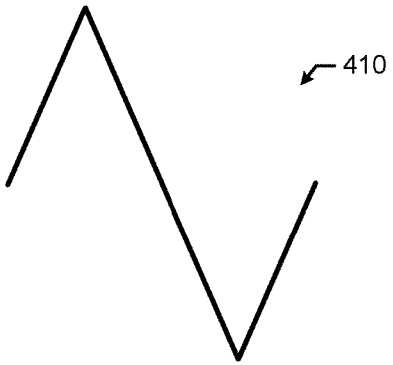
Figure 5A:
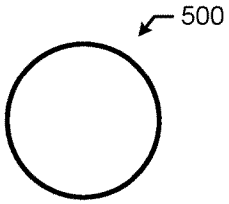
Figure 5B:
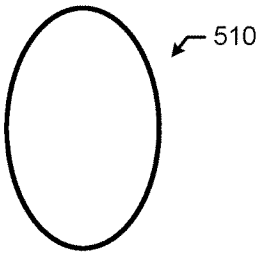
Figure 5C:
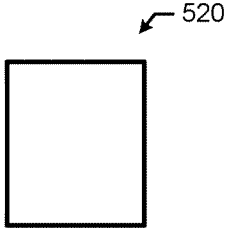
Figure 6:
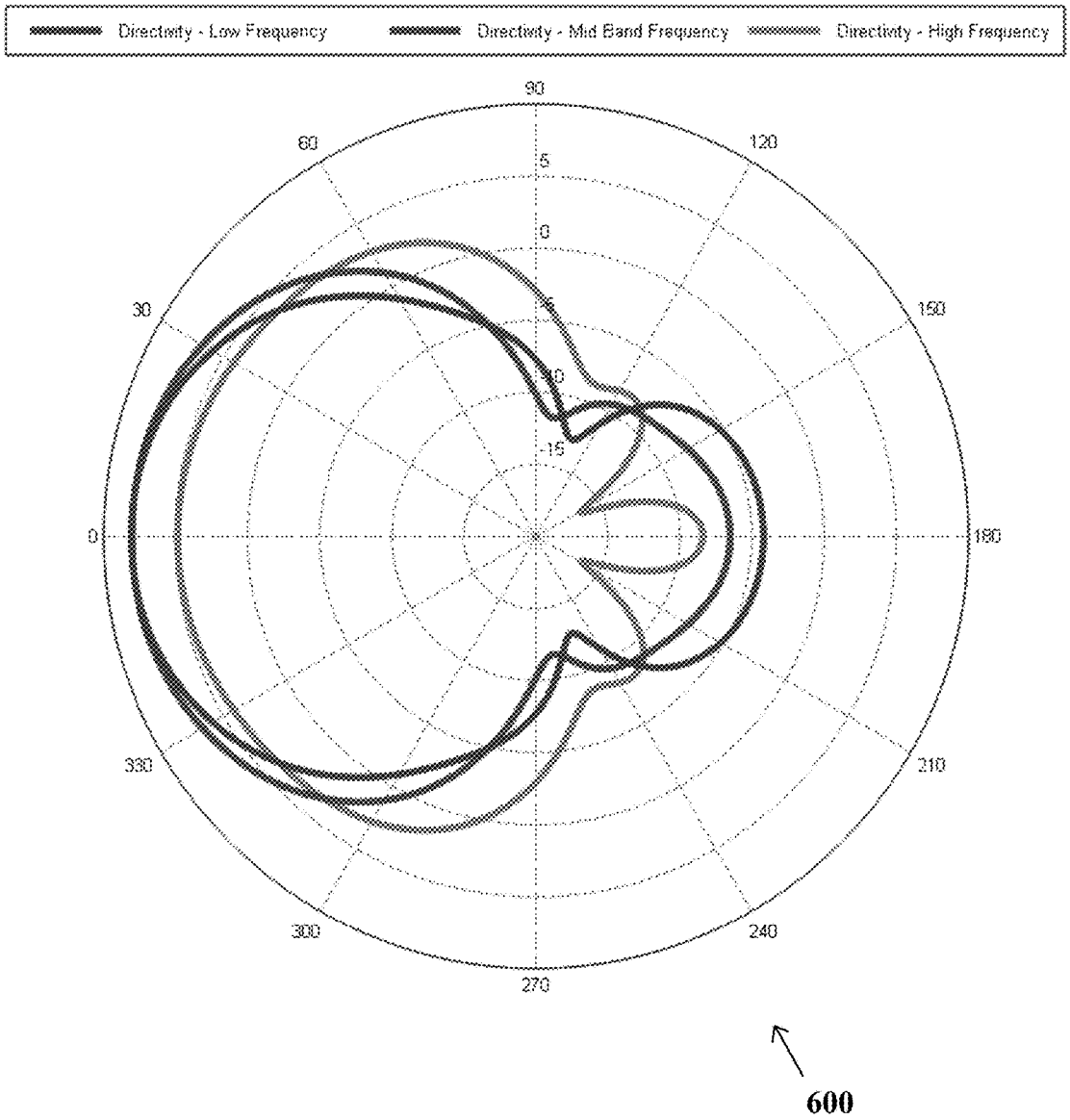
Figure 7:
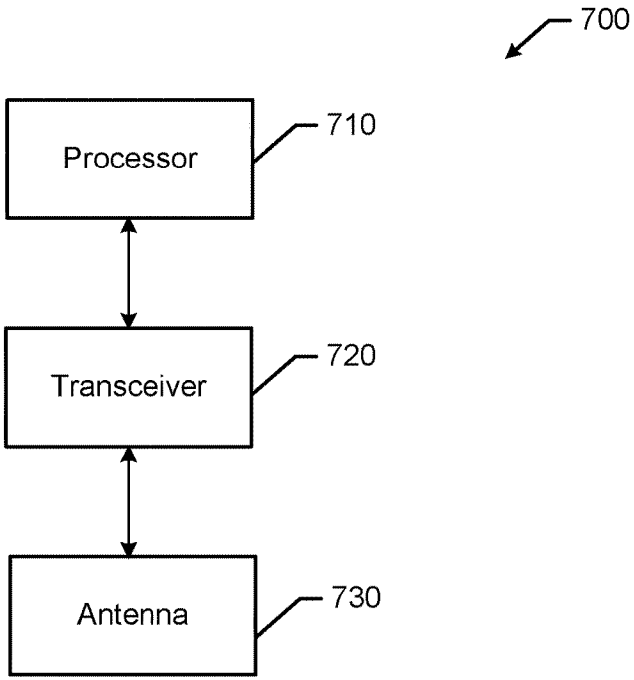
Figure 8:
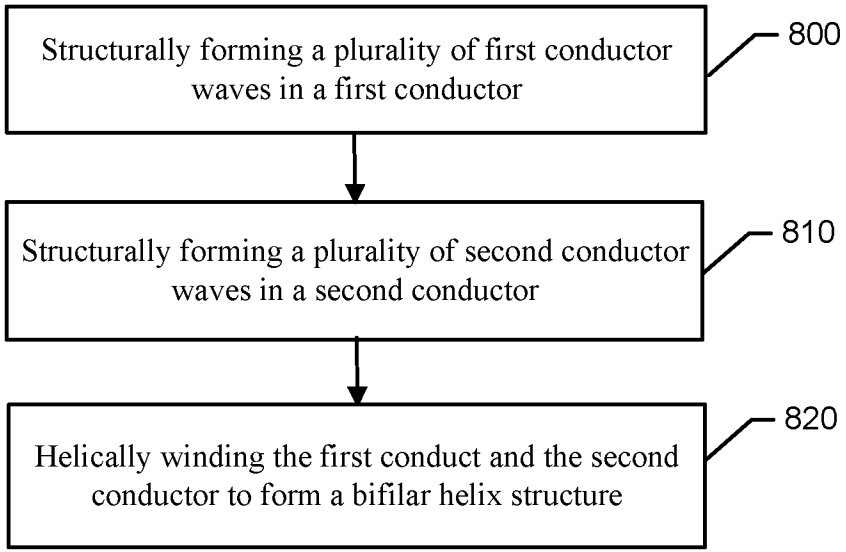

FIGS. 4*a* and 4*b* illustrate example structural waveforms for a conductor according to some example embodiments;

FIGS. 5*a* to 5*c* illustrate lateral cross-section views of example bifilar helix structures according to some example embodiments;

FIG. 6 is a polar directivity chart for an example antenna according to some example embodiments;

FIG. 7 is a block diagram of a communications device according to some example embodiments; and FIG. 8 is a flow chart of an example method according to some example embodiments.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability, or configuration. Rather, these example embodiments are provided to satisfy applicable legal requirements. Like reference numerals refer to like elements throughout.

The example embodiments described herein relate to antenna technology, and in particular bifilar helical antennas. Bifilar helical antennas include two conductors that are formed in an interlaced, double helix structure. The conductors are connected at both a signal feed end of the structure and at a load end of the structure. The bifilar helical structure generates a back fired or end fired beam that is directed towards the signal feed end of the structure. Further, the signal can be fed to the antenna structure in a balanced mode and therefore requires no ground plane unlike, for example, conventional axial mode helix antenna structures. According to some example embodiments, by incorporating frequency and amplitude modulated structural waves into the two conductors of the bifilar helical antenna, improved bandwidth and a smaller antenna by volume for a given operating frequency can be realized. In this regard, the phrase "structural wave" refers to a physical bending of the conductor to from a physical, spatial design. The inclusion of structural waves can provide for the antenna to occupy relatively less volume than conventional bifilar helix antennas and improved bandwidth. Example embodiments of the antenna structures described herein can operate in the ultra-high frequency (UHF) band, and the structures can be geometrically scaled to operate at higher or lower frequencies.

Figure 1:
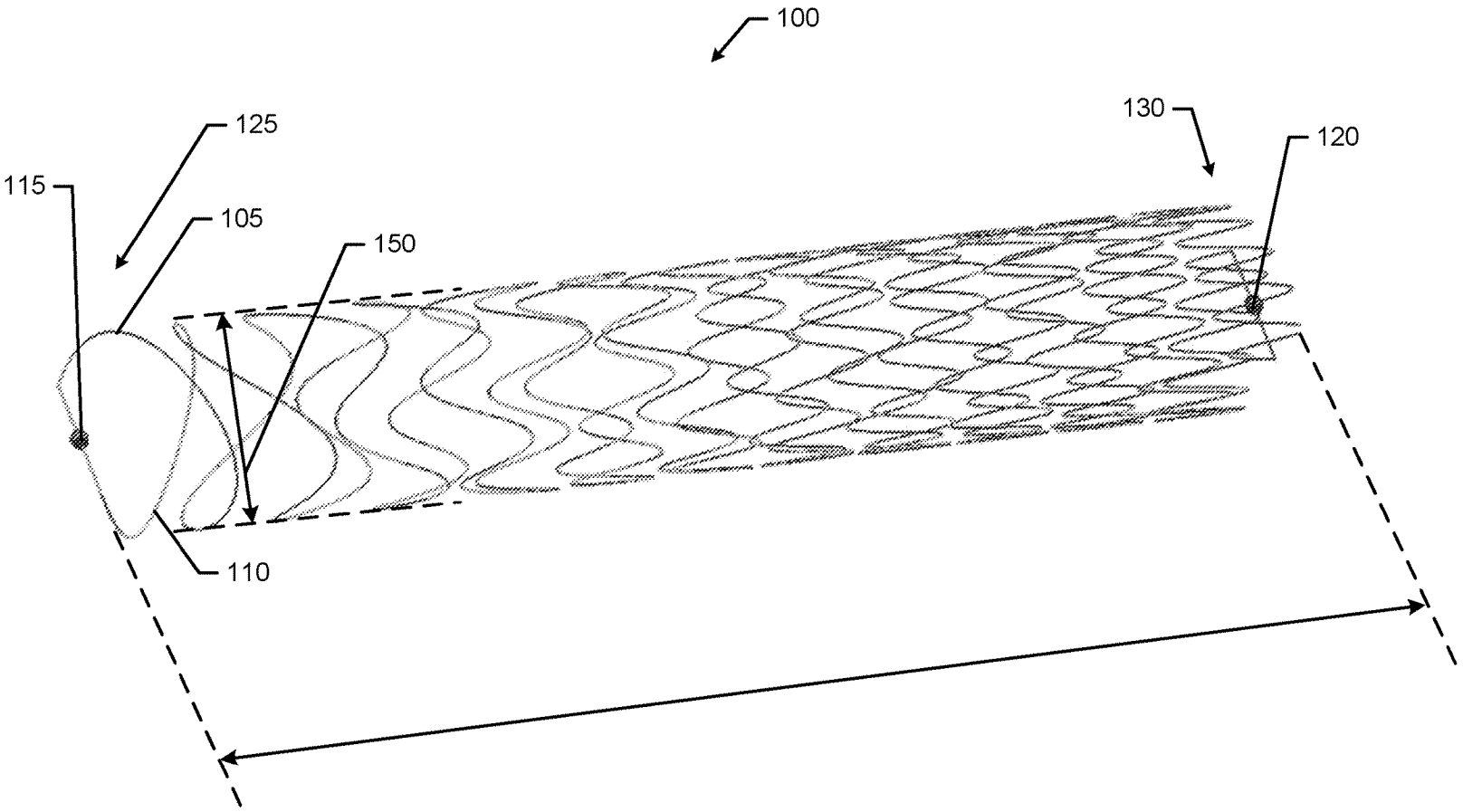
FIG. 1 illustrates an antenna assembly according to some example embodiments.

FIG. 1 illustrates an example improved bifilar helical antenna assembly according to some example embodiments. The antenna assembly 100, having a lengthwise form factor, may include a first conductor 105 and a second conductor 110. The first conductor 105 and the second conductor 110 may be composed of any conductive material, such as a metal material. The first conductor 105 and the second conductor 110 may be operably coupled (e.g., physically and electrically connected) at a signal feed point 115 located at a proximal end 125 of the antenna assembly 100. Further, the first conductor 105 and the second conductor 110 may be operably coupled (e.g., physically and electrically connected) at a load point 120 located at a distal end 130 of the antenna assembly 100. As such, the antenna assembly 100 may define an antenna length 140 measured from the proximal end 125 to the distal end 130. The antenna assembly 100 may further define a diameter 150 internal to the helical structure, where one half of the diameter is the radius of the helical structure.

According to some example embodiments, a load or impedance device may be operably coupled between the first conductor 105 and the second conductor 110 at the load point 120 to impedance match with a source impedance to the antenna assembly 100. According to some example embodiments, the load or impedance device may be a resistive load. The load or impedance device provided at the load point 120 may operate to improve impedance matching and traveling wave operation, while limiting reflections and operation as a resonant structure.

As can be seen in FIG. 1, the first conductor 105 and the second conductor 110 may be wound into a bifilar helix structure such that the conductors are interlaced and wrapped in a given shape, such as a cylinder as shown in FIG. 1. Further, each conductor 105, 110 may be structurally formed to include a plurality of structural waves (i.e., a plurality of first conductor structural waves and an plurality of second conductor structural waves). The structural waves of the individual conductors 105, 110 can be better seen in the exploded view of antenna assembly 100 provided in FIG. 2 where the first conductor 105 and the second conductor 110 are shown separately. Moving from the proximal end 125 to the distal end 130, it can be seen that the structural waves formed in the conductors 105, 110 can vary in amplitude (height) and in frequency (length).

The gain of the antenna assembly 100 may be determined by the antenna's volume as a function of the antenna assembly 100's length 140. The gain, which, for example, may be between 5 and 15 dBi (i.e., medium gain), may be adjustable by changing to the length 140. According to some example embodiments, changes to the length 140 may be obtained by changing a pitch in the helical coils (i.e., a distance between the helical coils) of the first conductor 105 and the second conductor 110 of the bifilar helix structure. Further, the antenna assembly 100 may exhibit right hand or left hand (circular, elliptical, etc.) polarization based on the sense or direction of twist for the bifilar helical structure.

Figure 3:
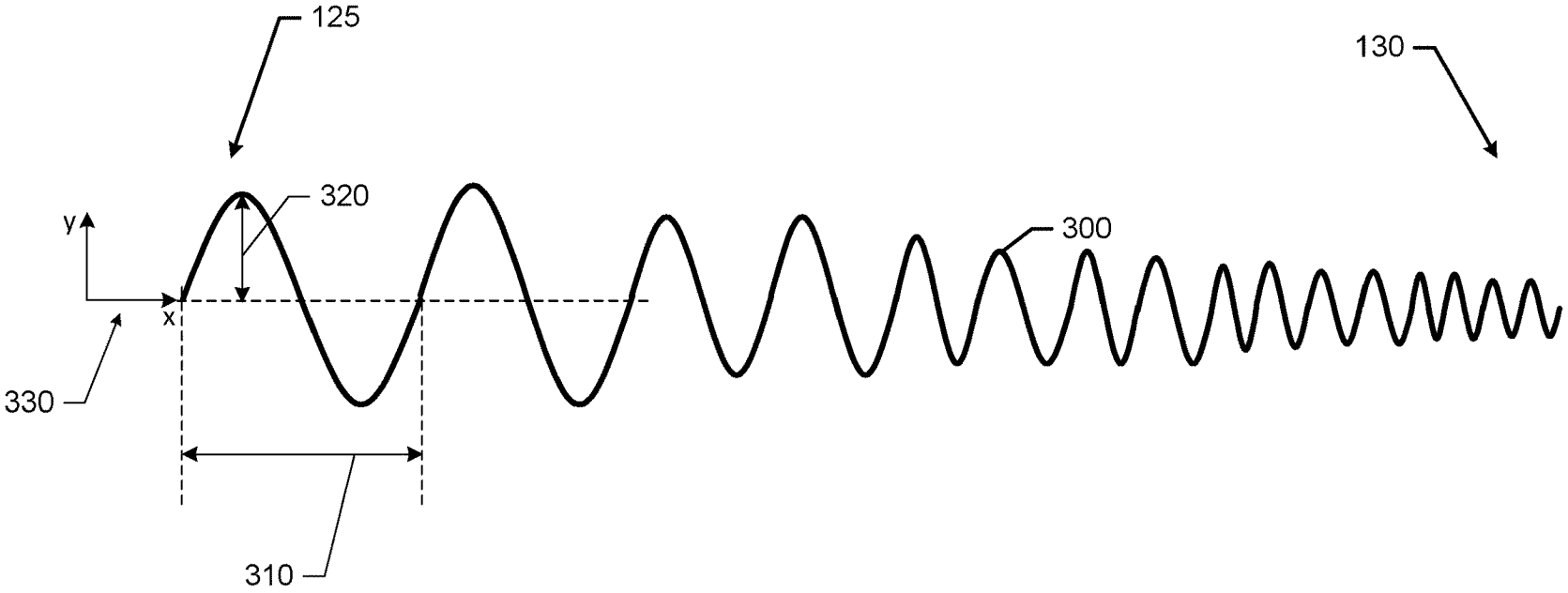
FIG. 3 illustrates an antenna conductor according to some example embodiments.

In this regard, FIG. 3 illustrates an example conductor 300 (which may be an embodiment of either the first conductor 105 or the second conductor 110) that is not yet wound into a helical structure, but includes the plurality of structural waves described above. With reference to FIG. 3, a structural wave may be defined as a portion of the conductor 300 that begins at a first point relative to an x-axis of coordinate system 330 and ends the same point relative to the x-axis of coordinate system 330 after having passed through a single maximum and a single minimum relative to the x-axis of the coordinate system 330. The length of a structural wave may also be referred to as a period of the structural wave, which is inversely proportional to a frequency of the structural wave. According to some example embodiments, a period of a structural wave may therefore be defined as a length between the zero crossings of the x-axis where a single maximum and a single minimum are included in the length. Additionally, each structural wave may define an amplitude (or height) of the structural wave, which may be measured from the x-axis of the coordinate system 330 to the maximum of the wave.

In FIG. 3, signal feed point may be located at the proximal end 125 and the load point may be located at the distal end 130. Based on the definitions above, the first structural wave of the conductor 300 has a period 310 and an amplitude 320. In view of this, it can be seen in FIG. 3 that the amplitude of the plurality of structural waves may be modulated. In this regard, increases in the amplitude of a given structural wave may cause an associated lengthening in the amount of the conductor 300 that is present in a unit volume of the associated antenna assembly. Further, the amplitudes of each of the plurality of structural waves may be different (e.g., increasing or decreasing from proximal end 125 to distal end 130). In this regard, the plurality of structural waves may be considered amplitude modulated. According to some example embodiments, with reference to FIG. 3, an amplitude of at least one of the structural waves disposed adjacent to the proximal end of the bifilar helix structure may be greater than a second amplitude of at least one of the structural waves disposed adjacent to the distal end of the bifilar helix structure. Similarly, an amplitude of each sequential structural wave on a conductor may decrease from the proximal end of the bifilar helix structure to the distal end of the bifilar helix structure. Because an increased length of the conductor 300 can be included in a smaller volume of the antenna assembly via amplitude modulation, a smaller antenna assembly by volume can be utilized for a given operating frequency, relative to, for example, a bifilar helix antenna that does not implement a plurality of structural waves that are amplitude modulated. In other words, an antenna assembly (e.g., antenna assembly 100) that defines a given antenna length from the proximal end 125 to the distal end 130 can have a target operating frequency, and that operating frequency may be a function of the amplitudes of structural waves. Accordingly, this amplitude modulation technique can result in more length of conductor per unit volume of the antenna assembly, which, in turn, can cause a slowing phase velocity during operation of the antenna assembly. As a result, the overall size of the antenna assembly can be smaller for given frequency of operation relative to a conventional bifilar helical antenna or a conventional axial mode helix antenna. Further, according to some example embodiments, for the same operating frequency, a reduced diameter of the bifilar helix can be realized, and in some cases, a reduction of 40% can be realized relative to a conventional bifilar helix antenna. In this regard, a diameter of the bifilar helix, according to some example embodiments, may be one sixth of the wavelength of the operating frequency.

As seen best in FIG. 3, the period associated with at least some of the structural waves of the conductor 300 may also be different. In this regard, according to some example embodiments, the plurality of structural waves of a conductor may be considered frequency modulated with respect to the structure. According to some example embodiments, the period of each sequential structural wave, referenced from the proximal end 125 to the distal end 130, may decrease in length (i.e., the frequency of the structural wave may increase). For example, for either the first conductor 105 or the second conductor 110, a first period of at least one of the structural waves disposed adjacent to the proximal end 125 of the bifilar helix structure may be greater in length than a second period of at least one of the structural waves disposed adjacent to the distal end 130 of the bifilar helix structure. By modulating the frequency (i.e., modifying the periods) of the structural waves, the conductor 300 can support broadband frequency operation of the antenna assembly, such as antenna assembly 100. As such, an operating frequency band for an antenna assembly described herein (e.g., antenna assembly 100) may be a function of a period of the structural of the conductors. In this regard, structural frequency modulation of the structural waves of the conductors can result in improved bandwidth performance of the antenna assembly, such as 67% or 2 to 1.

Figure 2:
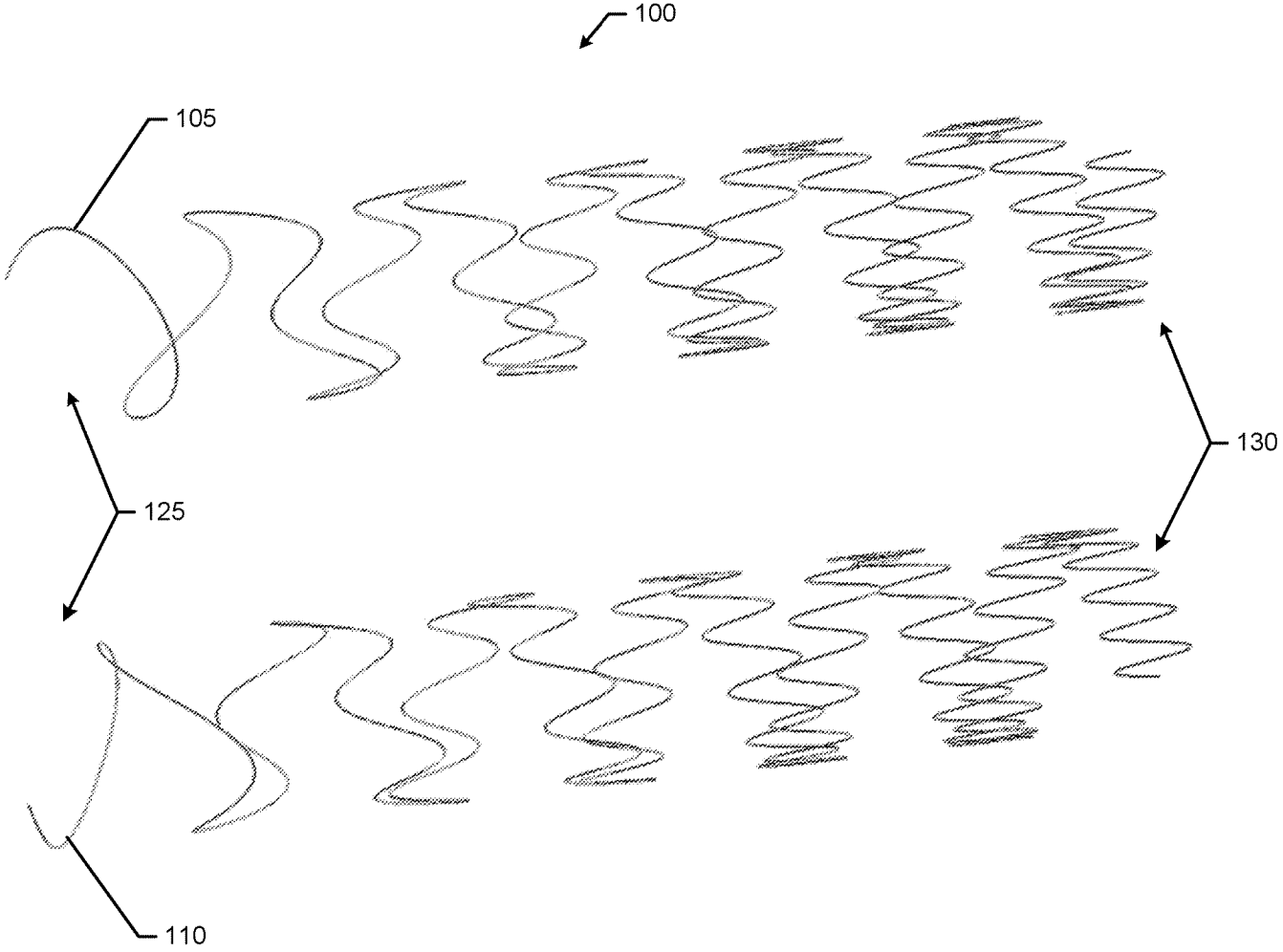
FIG. 2 illustrates an exploded view of an antenna assembly according to some example embodiments.

While FIGS. 1-3 illustrate structural waves that take a form similar to a sine or cosine function, according to some example embodiments, other forms of structural waves may be implemented. For example, FIG. 4*a* illustrates a square wave 400 that may be utilized as a structural wave in a conductor of an antenna assembly as described herein. Further, FIG. 4*b* illustrates a sawtooth wave 410 that may be utilized a structural wave in a conductor of an antenna assembly as described herein. These are merely some example structural waves that may be utilized in association with example embodiments. However, one of skill in the art would appreciate that various other types of waveforms may be utilized in conjunction with example embodiments.

FIGS. 5*a*-5*c* illustrate lateral cross-section views of bifilar helix antenna assemblies according to various example embodiments. In this regard, FIG. 5*a* illustrates a lateral cross-section view of a bifilar helix antenna assembly 500 having a circular cross-section (similar to the structure of the antenna assembly 100 of FIG. 1) and therefore has a constant radius measured from the center to the conductors. According to some example embodiments, the associated diameter of the bifilar helix antenna assembly 500 can be the operating frequency's wavelength divided by six. Alternatively, FIG. 5*a* illustrates a lateral cross-section view of a bifilar helix antenna assembly 510 having an elliptical cross-section and therefore has a non-constant radius measured from a center to the conductors. Further, FIG. 5*c* illustrates a lateral cross-section view of a bifilar helix antenna assembly 520 having a square cross-section and therefore has a non-constant radius measured from a center to the conductors. When non-constant radius structures are implemented, the approximate diameter or, for example, the average diameter, may be the wavelength of the operating frequency divided by six. Again, these are merely some example structures that may be utilized in association with example embodiments. However, one of skill in the art would appreciate that various other structures may be utilized in conjunction with example embodiments.

FIG. 6 is a polar plot 600 indicating the directivity of the radiation pattern generated by the antenna assembly 100 of FIG. 1. As mentioned above, the bifilar helical structure of the antenna assembly 100 generates a back and end fired beam towards the signal feed point 115, which is indicated by the relative high gain at 0 degrees. The plot 600 also indicates that the antenna assembly 100 has a high directivity across a wide band of frequencies (i.e., low, medium, and high frequencies) relative to an isotopic radiation pattern. The gain may be related to the directivity of the antenna assembly 100. Further, the gain may be a function of the directivity of the radiation pattern.

FIG. 7 illustrates a block diagram of a wireless communications device 700 that may utilize an antenna assembly as described herein. In this regard, the wireless communications device 700 may include a processor 710, a transceiver 720, and an antenna 730. The processor may be a general purpose processing device that is configured via software to direct the transceiver 720 and the antenna 730 to wirelessly communicate with other devices to support a given application. According to some example embodiments, the processor 710 may be hardware configured as an FPGA or an AASIC to direct the transceiver 720 and the antenna 730 to wirelessly communicate with other devices to support a given application. The transceiver 720 may be an electronic device, similarly configured in software or hardware, to support wireless communications with other wireless communications devices by driving the antenna 730 to wirelessly transmit data, or monitor antenna 730 to receive data. In this regard, transceiver 720 may operate to transform data provided by the processor 710 for transmission via the antenna 730. Alternatively, transceiver 720 may operate to transform data received by the antenna 730 and provide the transformed data to the processor 710 for analysis. In this regard, according to some example embodiments, the transceiver may be only a radio transmitter or only a radio receiver.

According to various example embodiments, the antenna 730 may be a bifilar helical antenna, such as antenna assembly 100, as described herein. In this regard, the antenna 730 may include a first conductor structurally formed into a plurality of first conductor structural waves and a second conductor structurally formed into a plurality of second conductor structural waves. The first conductor and second conductor may be helically wound to form a bifilar helix structure having a proximal end and a distal end. In this regard, the first conductor and the second conductor may be operatively coupled at the proximal end of the bifilar helix structure to form a signal feed point (e.g., which may be operably coupled to the transceiver 720), and the first conductor and the second conductor may be operatively coupled at the distal end of the bifilar helix structure to form a load point. Alternative and more specific arrangements of the antenna 730 are also possible in accordance with the various example embodiments described herein.

FIG. 8 is a flowchart of a method for providing an antenna assembly according to some example embodiments. It will be understood that each block of the flowchart, and combinations of blocks in the flowchart, may be implemented by various means, such as hardware or by hand. In this regard, a method of constructing an antenna assembly according to some example embodiments is shown in FIG. 8. The example method may comprise structurally forming a plurality of first conductor structural waves in a first conductor at 800, and structurally forming a plurality of second conductor structural waves in a second conductor at 810. The example method may further comprise, at 830, helically winding the first conductor and the second conductor to form a bifilar helix structure. The bifilar helix structure may have a proximal end and a distal end. The first conductor and the second conductor may be operatively coupled at the proximal end of the bifilar helix structure to form a signal feed point, and the first conductor and the second conductor may be operatively coupled at the distal end of the bifilar helix structure to form a load point.

Additionally, according to some example embodiments, a first period of at least one of the first conductor structural waves disposed adjacent to the proximal end of the bifilar helix structure may be greater in length than a second period of at least one of the first conductor structural waves disposed adjacent to the distal end of the bifilar helix structure. Additionally, or alternatively, a third period of at least one of the second conductor structural waves disposed adjacent to the proximal end of the bifilar helix structure may be greater in length than a fourth period of at least one of the second conductor structural waves disposed adjacent to the distal end of the bifilar helix structure. According to some example embodiments, a period of each sequential first conductor structural wave may decrease from the proximal end of the bifilar helix structure to the distal end of the bifilar helix structure. According to some example embodiments, an amplitude of each sequential first conductor structural wave may decrease from the proximal end of the bifilar helix structure to the distal end of the bifilar helix structure. Further, according to some example embodiments, at least one of the plurality of first conductor structural waves is formed as a sine wave, a square wave, or a sawtooth wave. Additionally or alternatively, the antenna assembly may define a given antenna length from the proximal end to the distal end, and an operating frequency of the antenna assembly may be a function of a amplitude of each first conductor structural wave for the given antenna length. An operating frequency band for the antenna assembly may be a function of a period of each first conductor structural wave. According to some example embodiments, a diameter of the bifilar helix structure need not be a constant, and a resistive load may be operably coupled to the load point to match a source impedance. Further, according to some example embodiments, the antenna assembly formed via the example method may be configured to operate in the absence of an operable coupling to a ground plane, and a diameter of the bifilar helix structure may be less than one-quarter of the wavelength (e.g., one sixth of the wavelength) of an operating frequency for the antenna assembly.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the invention. Moreover, although the foregoing describes exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. An antenna assembly comprising:

a first conductor structurally formed into a plurality of first conductor structural waves; and a second conductor structurally formed into a plurality of second conductor structural waves, wherein the first conductor and second conductor are helically wound to form a bifilar helix structure having a proximal end and a distal end, and wherein the first conductor and the second conductor are operatively coupled at the proximal end of the bifilar helix structure to form a signal feed point, and the first conductor and the second conductor are operatively coupled at the distal end of the bifilar helix structure to form a load point.

2. The antenna assembly of claim 1, wherein a first period of at least one of the first conductor structural waves disposed adjacent to the proximal end of the bifilar helix structure is greater in length than a second period of at least one of the first conductor structural waves disposed adjacent to the distal end of the bifilar helix structure.

3. The antenna assembly of claim 2, wherein a third period of at least one of the second conductor structural waves disposed adjacent to the proximal end of the bifilar helix structure is greater in length than a fourth period of at least one of the second conductor structural waves disposed adjacent to the distal end of the bifilar helix structure.

4. The antenna assembly of claim 1, wherein a period of each sequential first conductor structural wave decreases from the proximal end of the bifilar helix structure to the distal end of the bifilar helix structure.

5. The antenna assembly of claim 1, wherein the antenna assembly further comprises a resistive load operably coupled to the load point to match a source impedance.

6. The antenna assembly of claim 1, wherein the antenna assembly defines a given antenna length from the proximal end to the distal end; and wherein an operating frequency of the antenna assembly is a function of a amplitude of each first conductor structural wave for the given antenna length.

7. The antenna assembly of claim 1, wherein an operating frequency band for the antenna assembly is a function of a period of each first conductor structural wave.

8. The antenna assembly of claim 1, wherein a first amplitude of at least one of the first conductor structural waves disposed adjacent to the proximal end of the bifilar helix structure is greater than a second amplitude of at least one of the first conductor structural waves disposed adjacent to the distal end of the bifilar helix structure.

9. The antenna assembly of claim 1, wherein an amplitude of each sequential first conductor structural wave decreases from the proximal end of the bifilar helix structure to the distal end of the bifilar helix structure.

10. The antenna assembly of claim 1, wherein the antenna assembly is configured to operate in the absence of an operable coupling to a ground plane; and wherein a diameter of the bifilar helix structure is less than one-quarter of the wavelength of an operating frequency for the antenna assembly.

11. A communications device comprising:

a transceiver; and an antenna, the antenna being operably coupled to the transceiver, the antenna comprising:

a first conductor structurally formed into a plurality of first conductor structural waves; and a second conductor structurally formed into a plurality of second structural conductor waves, wherein the first conductor and second conductor are helically wound to form a bifilar helix structure having a proximal end and a distal end, and wherein the first conductor and the second conductor are operatively coupled at the proximal end of the bifilar helix structure to form a signal feed point, and the first conductor and the second conductor are operatively coupled at the distal end of the bifilar helix structure to form a load point.

12. The communications device of claim 11, wherein a first period of at least one of the first conductor structural waves disposed adjacent to the proximal end of the bifilar helix structure is greater in length than a second period of at least one of the first conductor structural waves disposed adjacent to the distal end of the bifilar helix structure.

13. The communications device of claim 12, wherein a third period of at least one of the second conductor structural waves disposed adjacent to the proximal end of the bifilar helix structure is greater in length than a fourth period of at least one of the second conductor structural waves disposed adjacent to the distal end of the bifilar helix structure.

14. The communications device of claim 11, wherein the antenna defines a given antenna length from the proximal end to the distal end; and wherein an operating frequency of the antenna assembly is a function of a amplitude of each first conductor structural wave for the given antenna length.

15. The communications device of claim 11, wherein an operating frequency band for the antenna is a function of a period of each first conductor structural wave.

16. The communications device of claim 11, wherein a first amplitude of at least one of the first conductor structural waves disposed adjacent to the proximal end of the bifilar helix structure is greater than a second amplitude of at least one of the first conductor structural waves disposed adjacent to the distal end of the bifilar helix structure.

17. The communications device of claim 11, wherein an amplitude of each sequential first conductor structural wave decreases from the proximal end of the bifilar helix structure to the distal end of the bifilar helix structure.

18. The communications device of claim 11, wherein the antenna is configured to operate in the absence of an operable coupling to a ground plane; and wherein a diameter of the bifilar helix structure is less than one-quarter of the wavelength of an operating frequency for the antenna.

19. A method for providing an antenna assembly comprising:

structurally forming a plurality of first conductor structural waves in a first conductor;

structurally forming a plurality of second conductor structural waves in a second conductor; and helically winding the first conductor and the second conductor to form a bifilar helix structure;

wherein the bifilar helix structure has a proximal end and a distal end; and wherein the first conductor and the second conductor are operatively coupled at the proximal end of the bifilar helix structure to form a signal feed point, and the first conductor and the second conductor are operatively coupled at the distal end of the bifilar helix structure to form a load point.

20. The method of claim 19, wherein the structurally forming the plurality of first conductor structural waves includes structurally forming the first conductor structural waves such that a period and amplitude of each sequential first conductor structural wave decreases from the proximal end of the bifilar helix structure to the distal end of the bifilar helix structure.

* * * * *